United States Patent [19]

Muckenfuhs et al.

[11] Patent Number: 4,696,416

[45] Date of Patent: Sep. 29, 1987

[54] LIQUID PRODUCT DISPENSING PACKAGE WITH SELF DRAINING FEATURE EMPLOYING DRIP CONCENTRATOR

[75] Inventors: Delmar R. Muckenfuhs, Middletown; Robert H. Van Coney, Cincinnati, both of Ohio

[73] Assignee: The Procter & Gamble Company, Cincinnati, Ohio

[21] Appl. No.: 8,805

[22] Filed: Jan. 30, 1987

Related U.S. Application Data

[63] Continuation of Ser. No. 656,049, Sep. 28, 1984, abandoned.

[51] Int. Cl.[4] ..... B67D 1/16

[52] U.S. Cl. ..... 222/109; 222/545

[58] Field of Search ..... 215/218, 221, 330; 53/320; 222/108–109, 111, 153, 420–422, 424, 465 R, 468, 481, 488–489, 544–545, 548–549, 551, 553, 562, 567–568, 571

[56] References Cited

U.S. PATENT DOCUMENTS

| | | | |
|---|---|---|---|
| 1,986,741 | 1/1935 | Moser | 221/147 |
| 2,061,685 | 11/1936 | Wheaton | 221/147 |
| 2,411,435 | 11/1946 | Kirschenbaum | 222/421 |
| 2,601,039 | 6/1952 | Livingstone | 222/109 |
| 2,669,370 | 2/1954 | Royall, Jr. | 215/47 |
| 2,715,480 | 8/1955 | Livingstone | 222/111 |
| 2,915,223 | 12/1959 | Beall, Jr. | 222/109 |
| 3,058,631 | 10/1962 | De La Hitte | 222/507 |
| 3,079,022 | 2/1963 | Tompkins | 215/6 |
| 3,300,104 | 1/1967 | Burt | 222/482 |
| 3,323,691 | 6/1967 | Ruetz | 222/421 |
| 3,369,710 | 2/1968 | Lucas | 222/109 |
| 3,434,637 | 3/1969 | Marcel | 222/570 |
| 3,833,150 | 9/1974 | Visser-Patings | 222/109 |
| 3,961,732 | 6/1976 | Roberts | 272/570 |
| 4,007,848 | 2/1976 | Snyder | 215/31 |
| 4,078,700 | 3/1978 | Hidding | 222/109 |
| 4,128,189 | 12/1978 | Baxter | 222/109 |
| 4,236,655 | 12/1980 | Humphries | 222/465 |
| 4,273,247 | 6/1981 | Earls | 215/228 |
| 4,298,145 | 11/1981 | Iida | 222/478 |
| 4,349,056 | 9/1982 | Heino | 141/381 |
| 4,550,862 | 11/1985 | Barker et al. | 222/109 |

FOREIGN PATENT DOCUMENTS

| | | |
|---|---|---|
| 129658 | 10/1976 | Japan . |
| 461760 | 6/1977 | Japan . |

*Primary Examiner*—Joseph J. Rolla
*Assistant Examiner*—Michael S. Huppert
*Attorney, Agent, or Firm*—E. Kelly Linman; John V. Gorman; Richard C. Witte

[57] ABSTRACT

A liquid dispensing package is described which is adapted to dispense liquids without mess. The package preferably incorporates a measuring cup which is also the closure for the package. The package of the present invention includes a container for storing the liquid product and a collar sealingly secured to a dispensing orifice on the container. The collar has an extended pouring spout and a transverse drain back partition with a drain hole to collect and return residual liquid to the container. A drip concentrating member originates in the lowermost surface of the drain back partition about the periphery of the drain hole and extends generally downwardly from the drain back partition toward the pouring spout to form a drip concentrating point in the interior of the container. Any liquid spilled on the exterior of the drain back partition or draining back onto the exterior of the drain back partition from the cap after a dispensing cycle is completed coalesces at the drip concentrating point. Coalescence of liquid at a single point causes a larger and larger droplet to form at the point. When the weight of the droplet finally exceeds the surface tension forces exerted by the liquid on the drip concentrating point, the droplet falls back into the container, and the process is restarted until the bulk of the liquid has been redeposited into the container.

20 Claims, 15 Drawing Figures

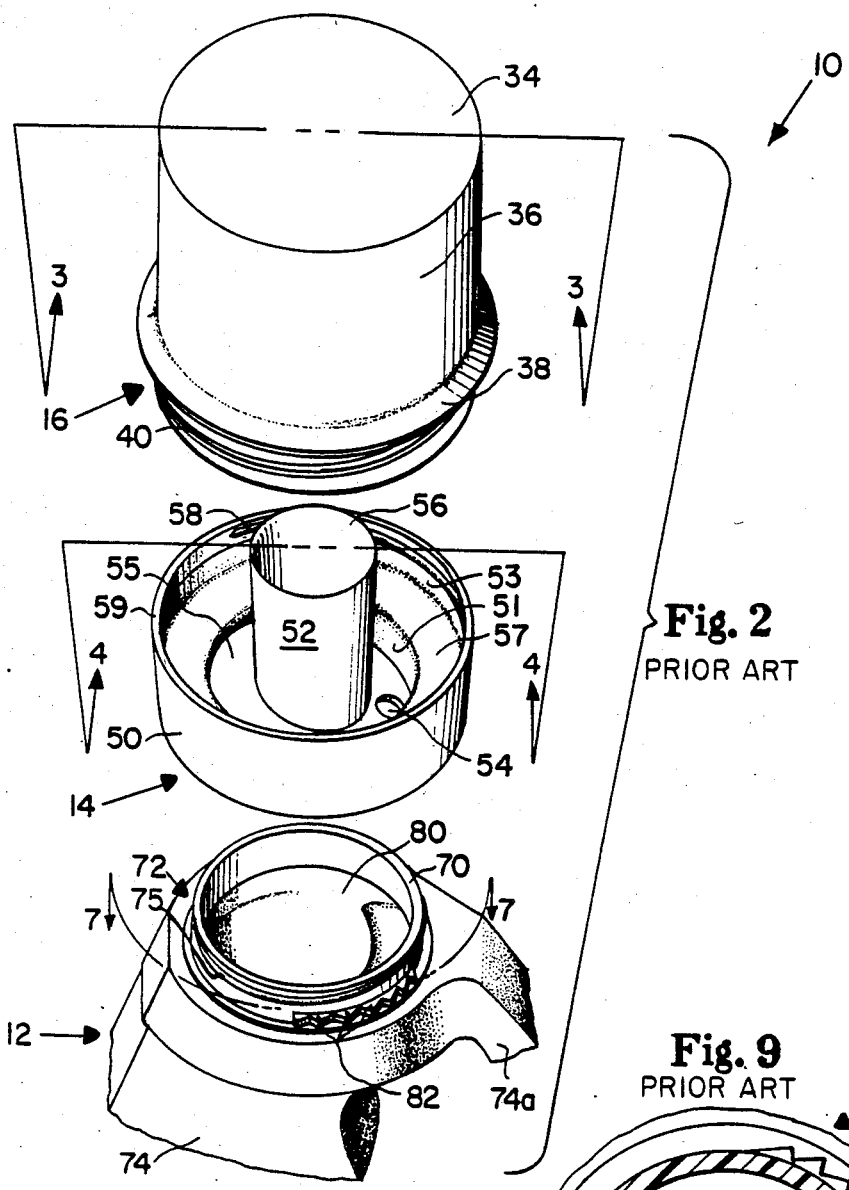
Fig. 2
PRIOR ART
Fig. 9
PRIOR ART
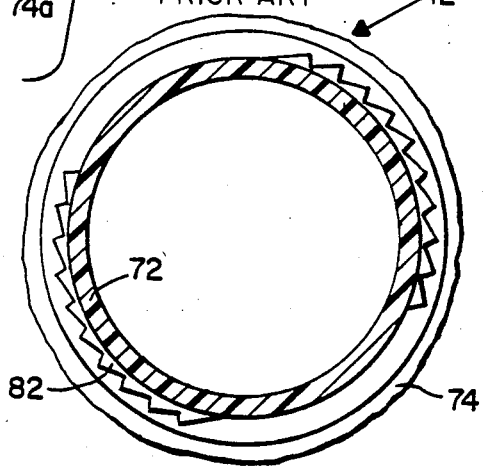

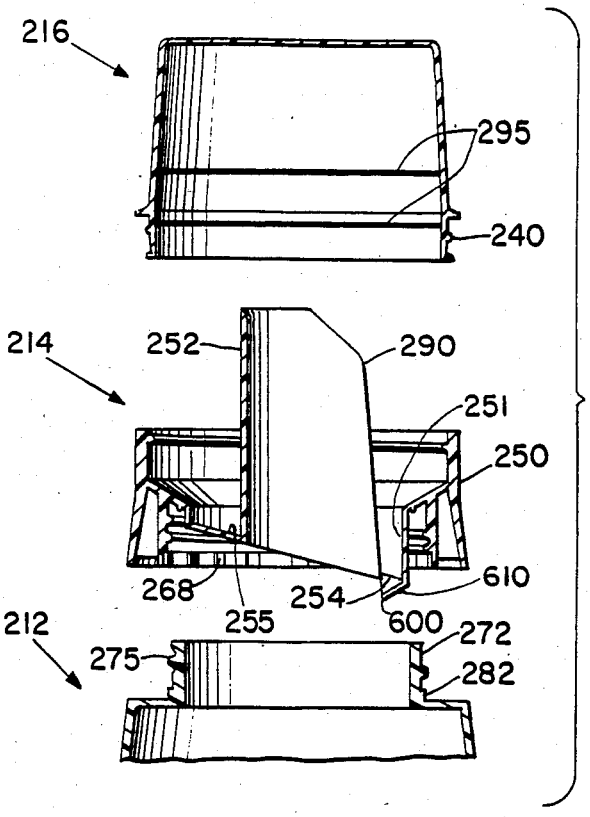
Fig. 11
Fig. 12
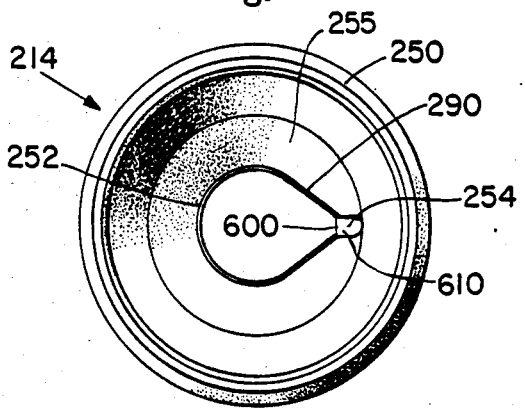

LIQUID PRODUCT DISPENSING PACKAGE WITH SELF DRAINING FEATURE EMPLOYING DRIP CONCENTRATOR

This is a continuation of application Ser. No. 656,049, filed on Sept. 28, 1984.

TECHNICAL FIELD

This invention relates to an improved dispensing package for liquid products wherein a drip concentrator is employed in conjunction with a self draining feature to enhance mess-free dispensing of the liquid product.

BACKGROUND ART

A great deal of work has been directed to cleaning up the messiness generally inherent in dispensing liquid products from their containers. U.S. Pat. No. 3,369,710, which issued to M. B. Lucas on Feb. 20, 1968, for example, discloses a pouring fitment which frictionally engages the outlet of a bottle and includes a retractable telescoping spout member. A similar adapter arrangement, is disclosed in U.S. Pat. No. 4,298,145, which issued to M. Lida on Nov. 3, 1981. In this latter patent, the antidrip adapter is formed by two concentric tubes integrally molded with an annular inclined guide plate connecting them.

A dripless pouring spout with a cooperating closure cap is disclosed by U.S. Pat. No. 4,078,700, which issued to W. E. Hidding on Mar. 14, 1978. In this patent, a pouring adapter similar to that of the described lida patent, but with the back portion of the tubular spout member open, incorporates a deformable antidrip and an annular inclined drip back surface to return excess liquid to the container. The cooperating closure cap member is formed with internal threads to mate with the external rib or thread of the container neck. U.S. Pat. No. 4,128,189, which issued to E. W. Baxter on Dec. 5, 1978, shows a pouring insert, very similar to those described in the patents of lida and Hidding, which is frictionally received and held in the neck of a dispensing bottle. In this patent, an insert cover is held in place by an annular cap whose internal threads mate with the external threads of the container.

Another dripless pouring spout comprising a pouring adapter with a closure cap is disclosed by U.S. Pat. No. 2,601,039, which issued to J. G. Livingstone on June 17, 1952. Livingstone describes a pouring adapter having an extended pouring spout with an open longitudinal slot on its rear surfaces, the spout being circumscribed by an inclined drainback surface which directs excess or spilled liquid back into the container. A cooperating cap for the adapter is to be frictionally or threadedly received on the upper exterior surfaces of the adapter.

Other prior work has been aimed at providing a liquid measuring device which also serves as the closure for the liquid container. U.S. Pat. No. 2,061,685, which issued to J. M. Wheaton on Nov. 24, 1936, discloses a closure with an integral measuring cup axially aligned therein and adapted to be applied with its open mouth extending substantially into the neck of the container bottle. The means for engagement with the container comprises an integrally formed annular flange having internal threads which mate with external threads on the bottleneck. An annular sealing ring is employed to insure a tight seal. U.S. Pat. 4,273,247, which issued to W. L. Earls on June 16, 1981, provides a closure-cup assembly having internal threads to mate with the external threads of the bottle or container. In this patent, the cup portion of the assembly is held in an inverted position encompassing and partially covering the exterior of said bottle or container when in the closed position.

A liquid container with a nondrip measuring cap is disclosed by U.S. Pat. No. 4,349,056, which issued to J. Heino on Sept. 14, 1982. A resilient insert telescoped in the neck of a container has a projecting annular lip designed to scrape along the inner wall of the measuring cap closure to remove the residual liquid thereon as the cap is applied to the neck of said container. The measuring cap may be frictionally held in place, or may have internal threads on its internal surfaces adjacent its open mouth. As used herein, residual liquid is that which remains on a package surface after the liquid contacts it during the dispensing operation. This can include spillage, dripping, residue, film and the like.

A particularly preferred liquid product pouring and measuring package intended to provide mess-free dispensing of measured quantities of liquid is disclosed in the commonly assigned, copending patent application of Dale E. Barker, Griscom Bettle III and Robert H. Van Coney entitled LIQUID PRODUCT POURING AND MEASURING PACKAGE WITH SELF DRAINING FEATURE, Ser. No. 545,579, filed Oct. 28, 1983 issued on Nov. 5, 1985 as U.S. Pat. No. 4,550,862, and hereby incorporated herein by reference.

In a particularly preferred embodiment of the Barker et al. invention there is provided a liquid dispensing and measuring package having a measuring cup which serves also as the closure device for the system, and which is adapted to allow mess-free, convenient, and economical dispensing and storage of a liquid product. The package includes a container comprising a body portion with an upwardly extending finish and a dispensing orifice. A transition collar mounted on the container finish has an outwardly extending pouring spout and a circumscribing wall having fastening means formed on its interior surface. A surface intermediate the spout and wall connects them and provides a means for conveying any spilled or residual liquid back into said container. A measuring cup has an open mouth terminating in a lip and is designed such that it is also the closure for said system. The cup has outwardly facing fastening means, such as threads or snap-fit protrusions, formed on its external surface adjacent said lip at its open end. The external fastening means on said measuring cup mate with the inwardly facing internal fastening means on the transition collar to attach and seal the cup in inverted condition.

While the aforementioned liquid dispensing and measuring package of Barker et al. has done much to alleviate the messiness problem inherent in other prior art liquid dispensing packages, it has nonetheless been observed that after a liquid dispensing cycle has been carried out using the package of Barker et al., some liquid usually remains on the exterior surface of the drain back partition of the transition collar, particularly near the drain hole which typically serves as the means for conveying the residual liquid back to the container. This residual liquid tends to spread across the exterior surface of the drain back partition of the transition collar during the next liquid dispensing cycle and may ultimately be discharged over the uppermost edge of the collar, thus causing a liquid mess on the outermost surface of the collar and ultimately on the outermost surface of the container.

Accordingly, it is an object of this invention to obviate the above-described problems, particularly those associated wtih the aforementioned dispensing package of Barker et al.

It is another object of the present invention to provide a liquid dispensing package which provides for the convenient, mess-free dispensing of said liquid, preferably with a measuring cup which can be replaced on said container as its closure with no resulting mess or inconvenience.

DISCLOSURE OF THE INVENTION

In accordance with one aspect of the presnt invention, there is provided an improved liquid dispensing package of the type generally disclosed in the aforementioned patent of Barker et al. In particular, the present package preferably includes a measuring cup which serves also as the closure device for the system. Like the package of Barker et al., a preferred embodiment of the present package includes a container comprising a body portion with an upwardly extending finish and a dispensing orifice. A transition collar mounted on the container finish has an outwardly extending pouring spout and a circumscribing wall having fastening means formed on its interior surface. A drain back partition, which is preferably inclined, is located intermediate the spout and wall and connects them. Like the package of Barker et al., the present package provides a means for conveying the bulk of any spilled or residual liquid back into the container. However, unlike the package of Barker et al., the present package includes, as part of the means for conveying spilled or residual liquid back into the container, a drip concentrating feature which directs the spilled or residual liquid to a point beneath the exterior surface of the drain back partition. The addition of a drip concentrating feature, preferably a single point, positioned at an elevation below the exterior surface of the drain back partition provides two important advantages over the structure of Barker et al.

First, any liquid spilled on the exterior of the drain back partition or draining back onto the exterior of the drain back partition from the cap after a dispensing cycle is completed coalesces at the drip concentrating point. Coalescence of liquid at a single point causes a larger and larger droplet to form at the point. When the weight of the droplet finally exceeds the surface tension forces exerted by the liquid on the drip concentrating point, the droplet falls back into the container, and the process is restarted until the bulk of the liquid has been redeposited into the container. Thus, little if any liquid remains on the exterior surface of the drain back partition for the next dispensing cycle.

The second advantage afforded by the drip concentrating feature of the present package is realized when the dispensing cycle is repeated. By placing the drip concentrating point at an elevation below the exterior surface of the drain back partition and orienting its wall generally toward the pouring spout, any residual liquid falling from the drip concentrating point during the dispensing cycle, i.e., while the package is inclined from its at rest vertical axis, will fall within the container, into the liquid product stream being discharged or onto the interior product contacting surface of the drain back partition rather than onto the exterior of the drain back partition.

As a result of the foregoing advantages, a dispensing package of the present invention exhibits greatly improved resistance to liquid contamination of its exterior surfaces, even after repeated dispensing cycles.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

FIG. 2 is a fragmentary, exploded, perspective view of the prior art embodiment of FIG. 1;

FIG. 9 is a horizontal cross-sectional view through the container finish taken below the means for attachment on the finish and showing the interlock means of the prior art embodiment shown in FIG. 1;

FIG. 11 is a fragmentary, exploded, vertical cross-sectional view of a package of the type shown in FIG. 10;

FIG. 12 is a top view of the transition collar of FIG. 11;

DETAILED DESCRIPTION OF THE INVENTION

Figure 1:
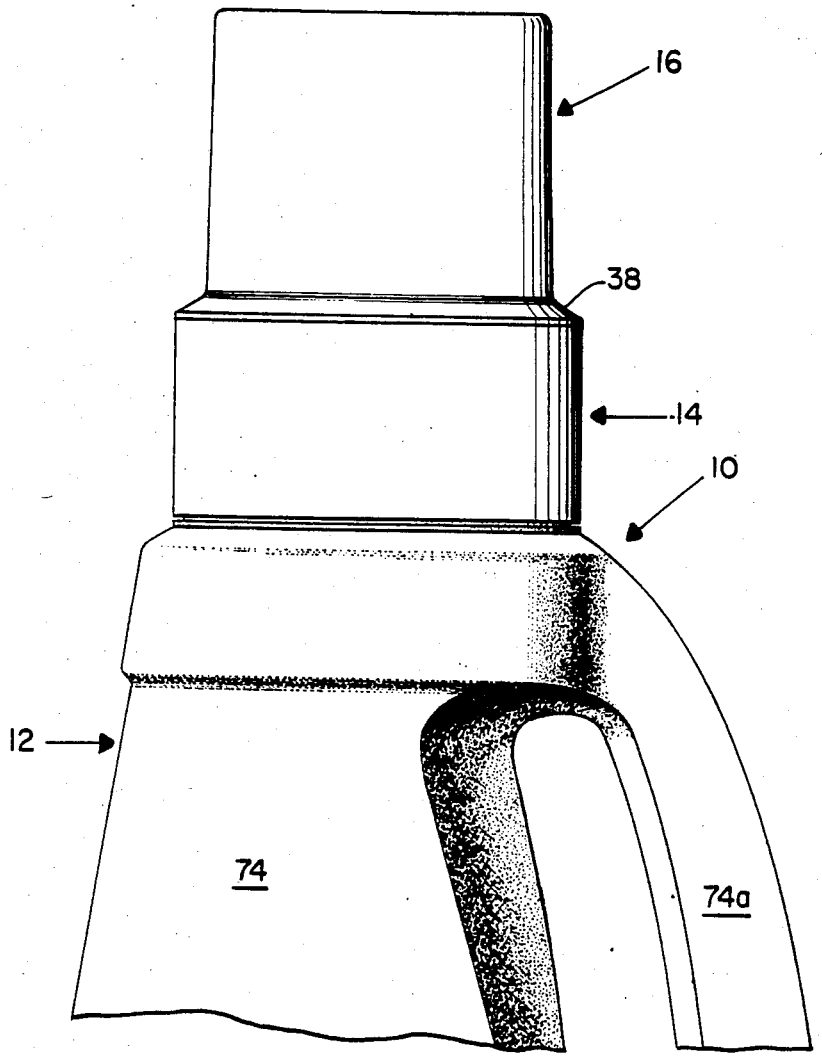
Fig. 1 PRIOR ART
FIG. 1 is a fragmentary front elevational view of a preferred embodiment of a prior art package of the type generally disclosed in the patent to Barker et al.

Referring now to the drawings in detail, wherein like numerals indicate the same elements throughout the views, there is illustrated a prior art embodiment of a liquid pouring and measuring package of the type generally disclosed in the commonly assigned copending patent application of Dale E. Barker, Griscom Bettle III and Robert H. Van Coney entitled LIQUID PRODUCT POURING AND MEASURING PACKAGE WITH SELF DRAINING FEATURE, Ser. No.

545,579, filed Oct. 28, 1983, issued on Nov. 5, 1985 as U.S. Pat. No. 4,550,862 and hereby incorporated herein by reference. The prior art package 10 includes a liquid product container 12, a transition collar 14 to be mounted on the container 12, and a measuring cup 16.

The container 12, which is typically constructed of a moldable polymeric material, such as polyethylene or polypropylene, has a body portion 74, an upwardly extending finish 72 and, as shown in FIG. 2, a flat annular lip 70 on the upper surface of the finish 72 defining orifice 80. The balance of the body portion 74 which is not shown in FIG. 1 provides a closed-end chamber suitable for containing the product to be dispensed. The body portion 74 has an integrally molded handle 74*a* to provide a prominent or recognizable gripping or hand hold means to facilitate dispensing and to properly orient the transition collar 14 during pouring of the product, as will be more fully understood from the subsequent description.

An interlock means, comprising a plurality of locking teeth 82, is located at the base of the container finish 72. These locking teeth 82 are shown best in FIG. 9 as being disposed in two diametrically opposed groups of several juxtaposed ratchet-type teeth 82 each, integrally molded around the base of the container finish 72 adjacent and below the thread convolutions 75 illustrated in FIG. 2.

Transition collar 14, which is typically injection molded of a thermoplastic material, such as polypropylene or the like, is slightly harder than the material of either the container 12 or the cup 16. This variance in hardness provides better sealing between the collar and the container, and the cup and the collar, as will be discussed below.

Figure 4:
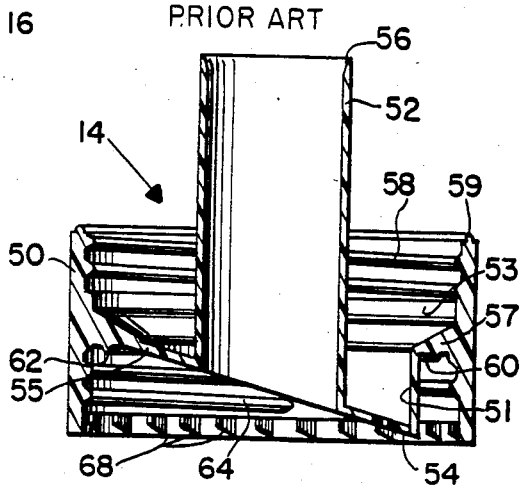
Fig. 4 PRIOR ART
FIG. 4 is a vertical cross-sectional view of the prior art transition collar of FIG. 2 taken along the line 4—4 thereof.

Transition collar 14 is best shown in FIGS. 2 and 4 as having a circumscribing cylindrical outer wall portion 50, an outwardly projecting tubular pouring spout 52, a drain-back shoulder 57 having a frusto conically configured upper surface and an inclined drain back partition 55. The drain back partition 55 and shoulder 57 essentially create a transverse partition which separates the outer wall portion 50 into top and bottom sections and has a hole 54 which serves as both a vent and a drain extending through the lowermost portion of drain back partition 55.

In the bottom section of transition collar 14, as best shown in FIG. 4, on the inner surface of the circumscribing wall 50 along the lowermost edge are a multiplicity of inwardly extending uniformly spaced locking teeth 68. The locking teeth 68 are integrally molded in the form of thin planar sections of material each of which lies at an angle of about 65° with a radial line intersecting its outermost extremity. The lower surfaces of the teeth 68 are upwardly inclined in an inward direction and the innermost surface of each is truncated at an angle which is approximately tangent to a circle connecting the inner ends of the teeth 68. The diameter of the circle is smaller than the diameter of a circle connecting the outer tips of the teeth 82 so that as the collar is applied, the teeth 68 must flex to slide past teeth 82. An interference of approximately 1.0 mm. between the teeth 68 and 82 has typically been found satisfactory. The teeth 68 are adapted to interlock with the locking teeth 82 of the container 12 and, in effect, perform a pawl-like function preventing rotational movement of transition collar 14 relative to the container 12 in the unfastening direction. In the embodiment shown in FIG. 4, there are 24 locking teeth 68 uniformly spaced at 15° intervals around the inner periphery of the lower portion of circumscribing wall 50 so that when said collar is securely tightened into said container, every other locking tooth 68 of the transition collar will interlock, with a locking tooth 82 in the container 74 and, therefore, restrict any rotation in the loosening direction. The resultant interlock action between said container and said collar will allow the measuring cup 16 to be removed and replaced on the upper portion of transition collar 14 without causing rotation of collar 14.

Adjacent and above locking teeth 68 in the bottom section of transition collar 14 are threads 64 which cooperate with threads 75 on container finish 72. Where collar 14 has a drain back partition with a drain hole, such as vent/drain hole 54, the collar 14 is oriented so that users will not pour the contained liquid from both the spout 52 and the vent/drain hole 54 simultaneously, which would prevent proper venting and make it difficult to control the stream of product. In the described embodiment the threads 64 of the collar 14 and the threads 75 of the container 12 are designed and matched so as to mount the transition collar 14 onto container 12 and orient the vent/drain hole 54 so that it is generally radially aligned with and adjacent, e.g. within about 30° of, the hand hold means (handle 74*a*) when tightened. In tightened condition the annular sealing ring 82 on the lower surface 60 of drain back shoulder 57 of the collar 14 will contact and slightly deform or cut into the softer material of the flat lip 70 of container 12, thus creating a tight seal. As shown in FIG. 4, the annular lower surface 60 of the drain back shoulder 57 is substantially flat and at right angles with the axis of collar 14, so that the sealing ring 62 can fully contact flap lip 70.

Drain back shoulder 57 is integrally attached on its outer periphery to the inner surface of circumscribing wall 50, and its upper surface is inclined steeply toward the central axis of transition collar 14. The angle of inclination of the surface of shoulder 57 is steep enough to facilitate gravitational movement of any residual liquid placed thereon toward the vent/drain hole 54. In the illustrated embodiment the shoulder 57 is sloped at approximately 30° relative to the horizontal. The inclined drain back partition 55 is integrally attached to both the inner periphery of drain back shoulder 57 and the outer surface of the extended pouring spout 52. Because of the inclined nature of the partition 55, a truncated cylindrical drain back wall 51 provides the connection between the partition 55 and the inner periphery of said drain back shoulder 57 to complete the separation of the top and bottom sections of collar 14 in locations other than through vent/drain hole 54.

Figure 6:
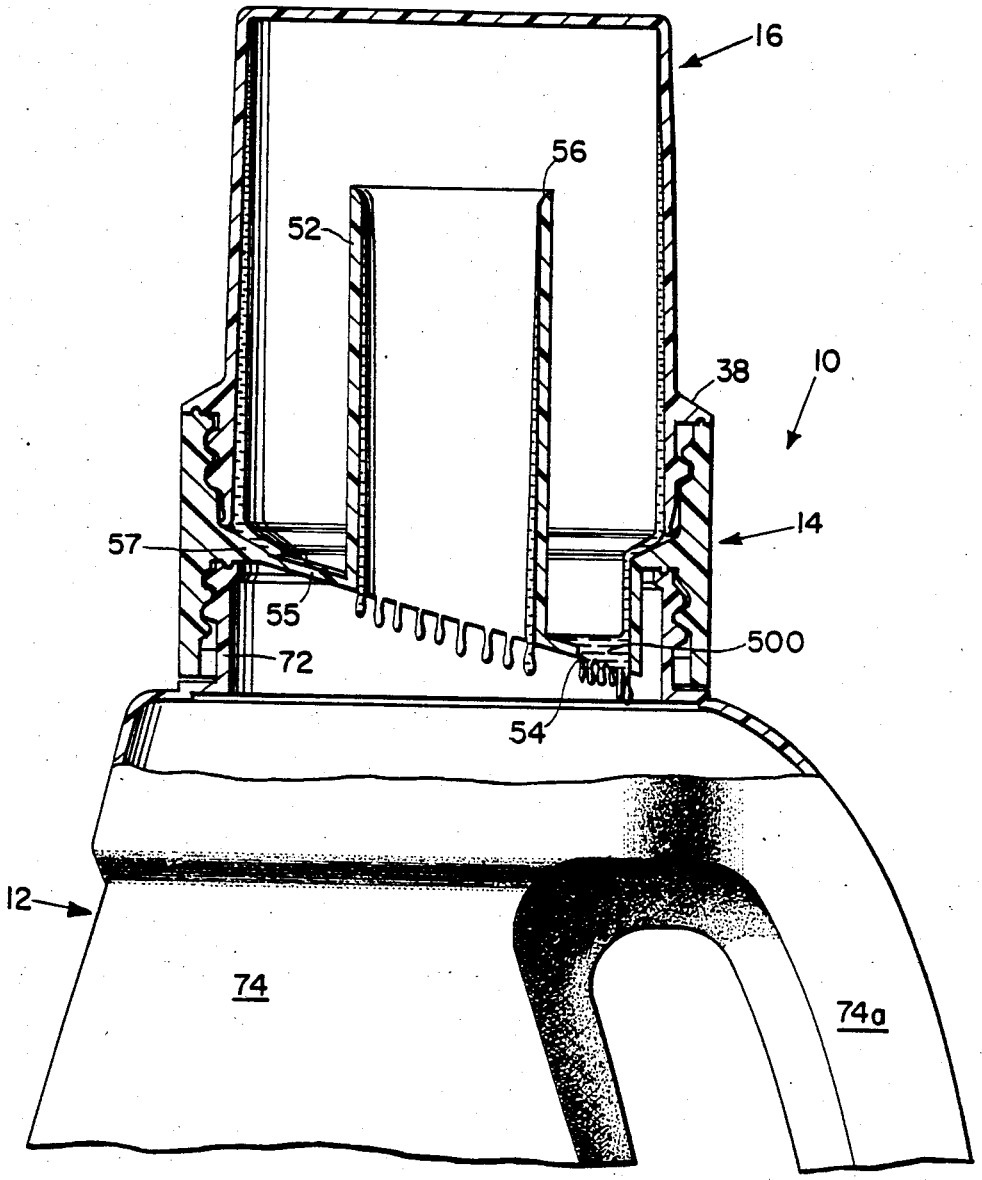
Fig. 6 PRIOR ART
FIG. 6 is a fragmentary, vertical, partial cross-sectional view of the prior art package of FIG. 1 in closed condition immediately following a dispensing cycle.

In the top section, extended pouring spout 52 is coaxial with the transition collar 14 in the embodiment shown. The diameter of pouring spout 52 is sized for convenience in pouring the particular liquid involved. The overall height of said spout 52 fits within said inverted cup 16 in the sealed position, as seen in FIG. 6, and extends outwardly from collar 14 a sufficient distance to insure maximum dispensing and mess control, whether the container is completely full or partially empty.

The uppermost surface of spout 52 in the illustrated embodiment includes a lip 56 designed to minimize dripping action of liquid. In the illustrated embodiment, lip 56 is formed by beveling or rounding-off the inner surface of the distal end of spout 52 to create a sharper conformation, as best seen in FIG. 4.

Adjacent to and above drain-back shoulder 57 and formed on the inner surface of the circumscribing wall 50, is an annular interior wall 53. Interior wall 53 has a diameter slightly smaller than the internal passageway elements formed above it and is sized as to form an annular contact seal with measuring cup 16 when it is engaged with collar 14. Annular wall 53 is tapered, so that its diameter adjacent shoulder 57 is smaller than its diameter at higher levels, to enhance its sealing capability. Above annular wall 53, also on the inner surface of said circumscribing wall 50 and adjacent its top surface, are formed a fastening means, inwardly facing threads 58, to receive the corresponding outwardly facing threads 40 of measuring cup 16 to be described. The top surface of circumscribing wall 50 is formed with a sealing ring 59 to contact and form a tight seal with cup 16 when the same is threadedly attached to collar 14. The heights of sealing rings 59 and 62, of course, are designed to compensate for the various tolerances of the molded parts. Both will seal because of the interaction of the hard sealing ring pressing against or into softer sealing surfaces, as described above.

Figure 3:
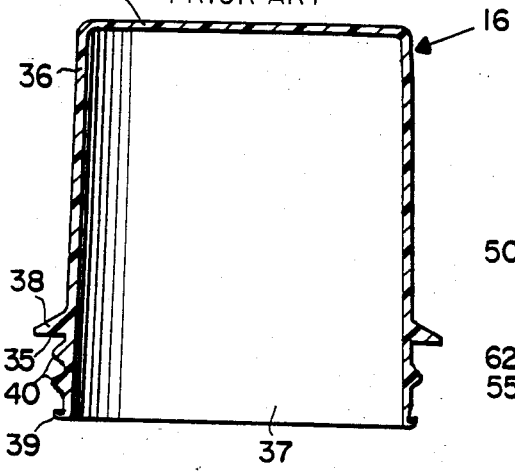
Fig. 3 PRIOR ART
FIG. 3 is a vertical cross-sectional view of the prior art measuring cup taken along the line 3—3 of FIG. 2.

The measuring cup 16 is shown in FIG. 3 as being generally cup-shaped with a bottom wall 34, a depending skirt-like sidewall 36, and an open mouth 37 terminating in a lip 39. The cup 16 is typically injection molded of a fairly dense polymer, such as medium to high density polyethylene, for compressive strength. As discussed earlier, the illustrated embodiment utilizes softer material for the container 12 and cup 16 to allow the sealing rings 62 and 59 on the collar 14 to slightly deform or cut into the mating surfaces.

As best shown in FIG. 3, lip 39 is formed as a drip-prevention lip for cup 16 when the same is used as a measuring cup, and to be an inner seal in contact with annular interior wall 53 of the collar 14 when cup 16 is used as the closure for the package 10. This is accomplished by having the lip 39 flare outwardly and terminate in a sharp edge. The sealing function of the lip 39 is best illustrated by the cross-sectional view in FIG. 6, showing the closed package immediately following a liquid dispensing cycle.

Adjacent lip 39 on the external surface of said cup is an outwardly facing fastening means, threads 40, adapted to cooperate with the inwardly facing threads 58 of collar 14.

A coaxial shoulder 38, located adjacent the side of the threads 40 spaced from the lip 39, projects outwardly from the exterior surface of sidewall 36 and provides a sealing surface 35 adapted to contact sealing ring 59 on the upper surface of circumscribing wall 50 of collar 14 when the measuring cup 16 is fastened in inverted condition on the collar 14. In the illustrated embodiment, as can best be seen in FIG. 3, the substantially flat, annular sealing surface 35 of shoulder 38 extends radially from said sidewall 36 at approximately a 90° angle.

The width of projecting shoulder 38 is sufficient to insure complete surface contact between ring 59 and sealing surface 35. The thickness of shoulder 38 is great enough to provide sufficient rigidity for surface 35 to insure a tight seal with the collar 14 as described above.

The portion of cup 16 extending below sealing surface 35, as shown in FIGS. 2 and 3, including threads 40 and drip prevention lip 39, are dimensioned so that the surface 35 will contact and seal with sealing ring 59 prior to any substantial contact of drip-prevention lip 39 with drip back shoulder 57 when cup 16 is threadedly attached to collar 14.

Figure 5:
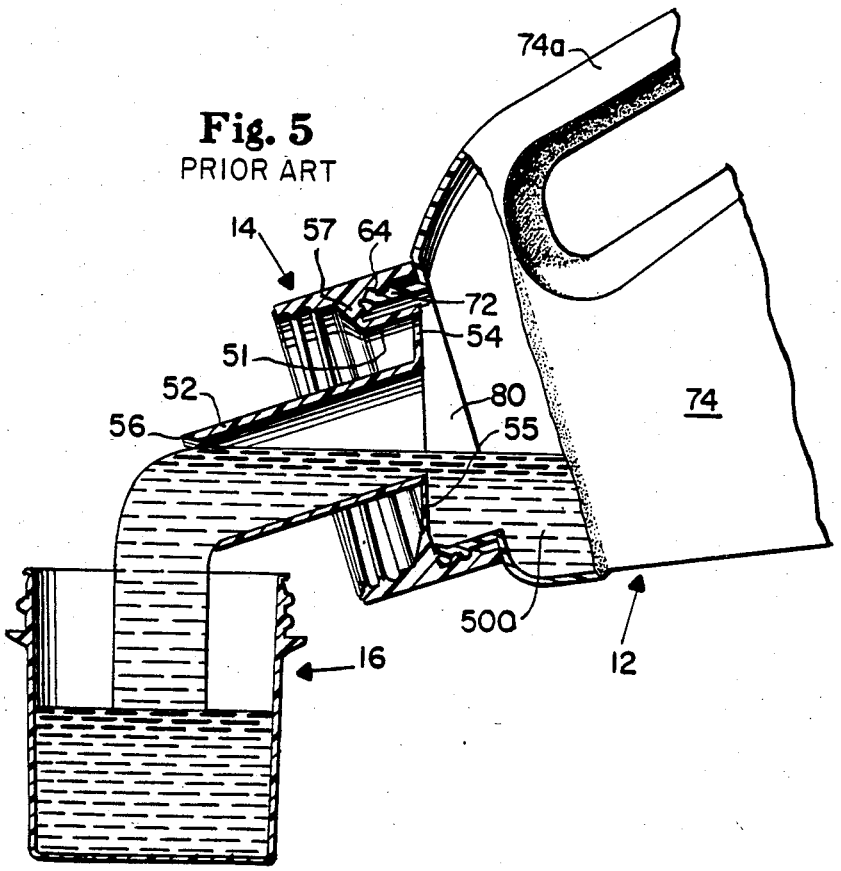
Fig. 5 PRIOR ART
FIG. 5 is a fragmentary, vertical cross-sectional view of the prior art package of FIG. 1 during the initial dispensing operation with the measuring cup performing its measuring function.

FIG. 5 discloses the prior art package of FIG. 1 during an initial dispensing cycle for the liquid 500 housed in container 12. The removable cup 16 is being utilized as a measuring receptacle. When cup 16 is filled to a desired level, container 12 is brought to an upright position. Spout lip 56 minimizes the liquid which might otherwise drip therefrom. The bulk of any liquid which does drip from the pouring spout 52 runs down its exterior surface and collects on the inclined drain back partition 55 and from there gravitates generally toward vent/drain hole 54. Once cup 16 has been emptied, it is returned to the installed position generally shown in FIG. 6. Residual liquid in cup 16 drains down onto drip back shoulder 57, gravitates toward the central axis of the transition collar 14, and along with any other collected residual liquid moves along the inclined drain back partition 55 toward vent/drain hole 54, as generally shown in FIG. 6.

Figure 7:
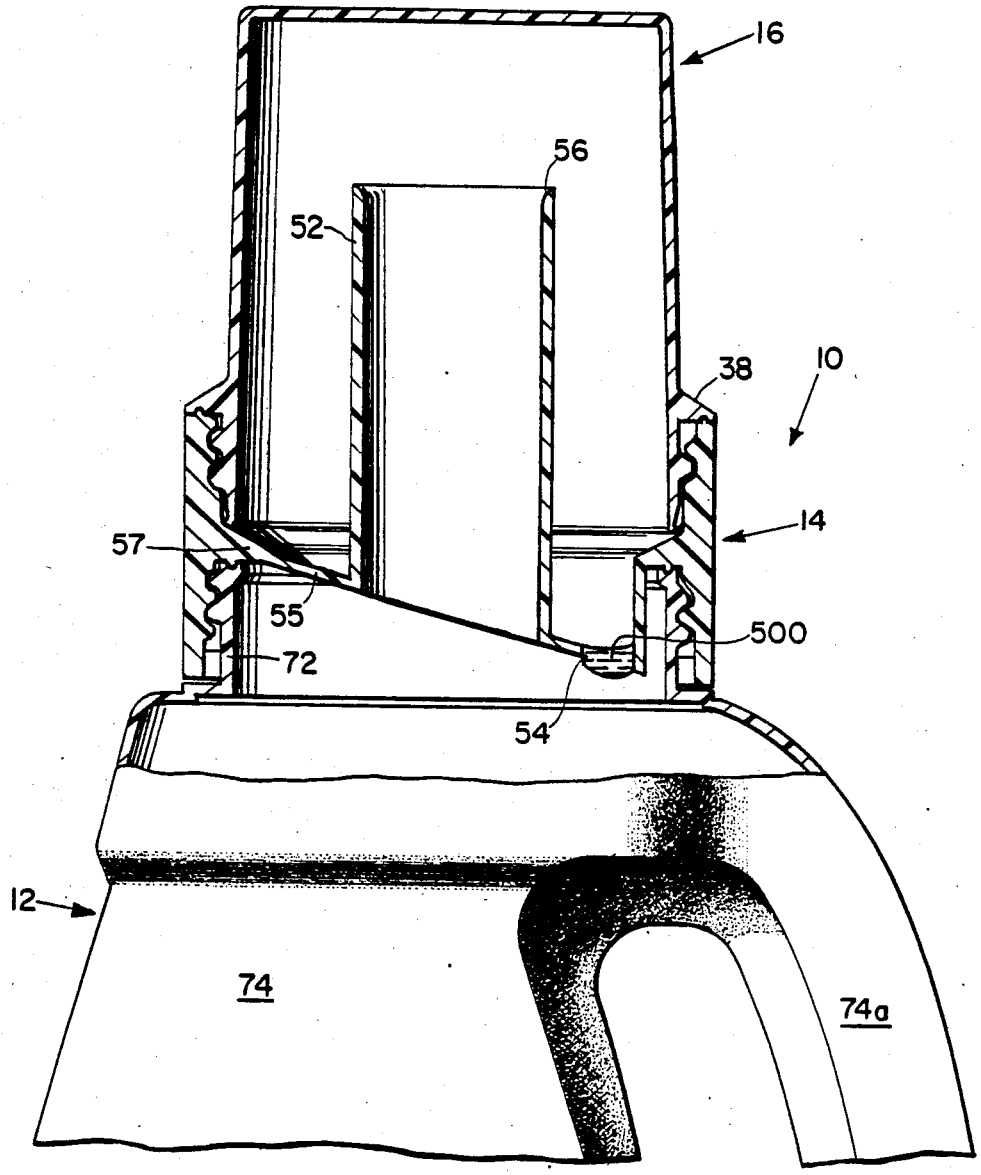
Fig. 7 PRIOR ART
FIG. 7 is a fragmentary, vertical, partial cross-sectional view of the prior art package shown in FIG. 1 in closed condition when a substantial period of time has passed following a dispensing cycle.

FIG. 7 illustrates the condition which exists after a period of time has elapsed since the last dispensing cycle. At this point, the surfaces of spout 52 and the interior of cup 16 are substantially free of residual liquid. Note, however, that there still remains a quantity of liquid in contact with the exterior surface of the lowermost end of drain back partition 55, particularly in the area of vent/drain hole 54. This is believed due to: (1) capillary forces exerted on the liquid by the groove formed from the intersection of drain back partition 55 and annular wall member 51; and (2) the tendency of the liquid 500 to from a meniscus bridging vent/drain hole 54, as generally shown in FIG. 7.

Figure 8:
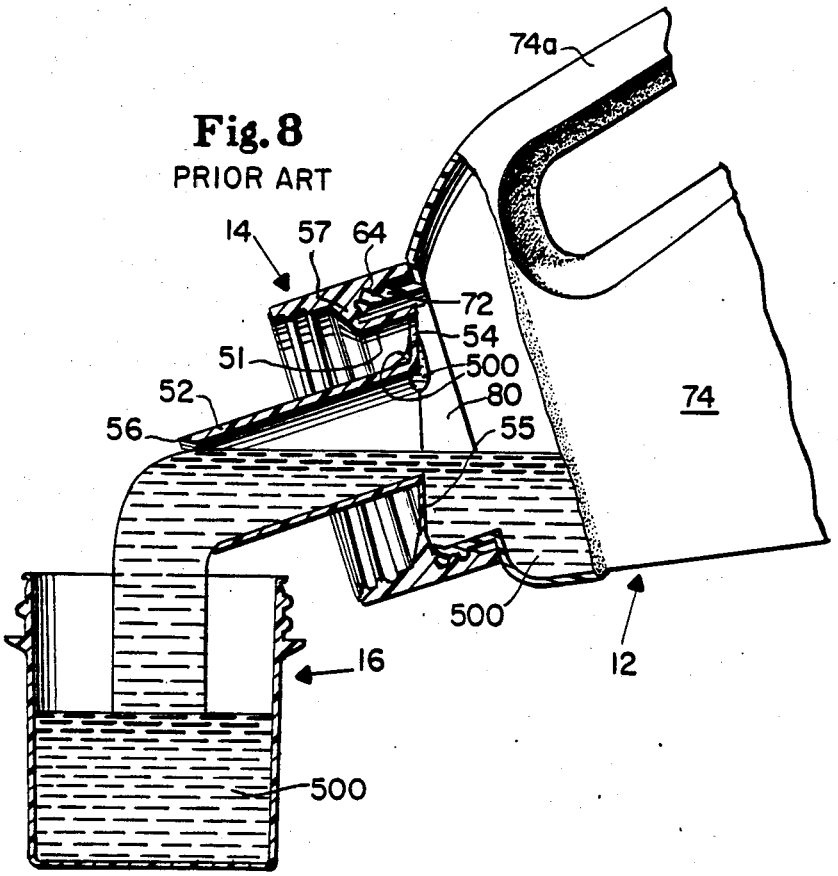
Fig. 8 PRIOR ART
FIG. 8 is a fragmentary, vertical cross-sectional view of the prior art package shown in FIG. 7 during a subsequent dispensing operation with the measuring cup performing its measuring function.

FIG. 8 shows the container of FIG. 7 on a subsequent dispensing cycle generally similar to the one shown in FIG. 5. In particular, the liquid 500 remaining in contact with vent/drain hole 54 and the exterior surface of drain back partition 55 is now repositioned to a more nearly vertical orientation, as generally shown in FIG. 8. In this orientation, a portion of this residual liquid is now free to spread across the exterior surface of drain back partition 55 and, depending upon the length of time the container remains in a dispensing position, may find its way to the exterior surface of transition collar 14. Any such liquid which reaches the exterior surface of transition collar 14 will, upon reorienting of container 12 to a vertical at rest position spread to the exterior surfaces of the container, thereby creating a liquid mess.

FIGS. 8–14 illustrate a particularly preferred embodiment of a liquid product pouring and measuring package of the present invention. The package 200 comprising container 212, transition collar 214 to be mounted on container 212, and measuring cup 216 are generally similar to the corresponding elements of the prior art embodiment shown in FIG. 1. In the condition illustrated in FIG. 10, the package 200 has already undergone a liquid dispensing cycle of the type generally illustrated in FIGS. 5 and 8, and a period of time sufficient for the bulk of the spilled and residual liquid to have reentered container 212 has elapsed.

Container 212 corresponds substantially identically to container 12, as described with regard to prior art package 10 with the exception that the upwardly extending finish 272 of container 212 extends upwardly somewhat higher than did the corresponding finish 72. Interlocking teeth 282 and thread convolutions 275 correspond exactly to parts 82 and 75 of package 10.

Transition collar 214 contains many features which are similar to those of prior art transition collar 14, described earlier herein. However, pouring spout 252 is formed with an open backside 290, and hole 254 which serves as both a vent and a drain extends from the open bottom of spout 252. Pouring spout 252 is shown as being located centrally with respect to the central axis of transition collar 214; however, it is contemplated that spout 252 could be located slightly off-center (not shown) to aid in pouring accuracy and convenience. Locking teeth 268 correspond exactly to locking teeth 68 described above with respect to prior art transition collar 14. The lower portion of outer wall 250 of transition collar 214 is flared outwardly and downwardly to better conform to the shape of the upper portions of container 212. It is further contemplated that spout 252 and vent/drain hole 254 could be formed with a thin removable membrane or tear strip (not shown) over their open portions for sealing of the package prior to initial use.

Figure 13A:
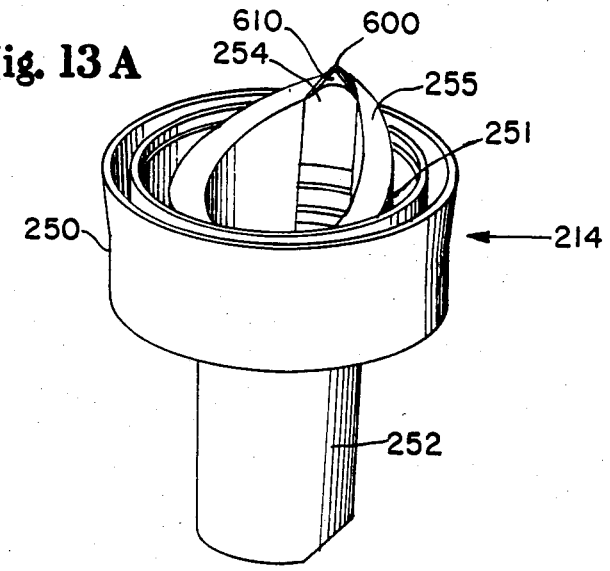
FIG. 13A is a perspective view of the transition collar shown in FIGS. 11 and 12 in an inverted position.

Transition collar 214 differs substantially from prior art transition collar 14 in that it includes a drip concentrating feature comprising a drip concentrating point 600 formed by a conical wall segment 610 extending about the periphery of vent/drain hole 254, as generally shown in FIG. 13A. As can be seen in FIG. 11, the conically shaped wall segment 610, which is preferably inwardly oriented toward spout 252, preferably intersects the vertical annular wall member 251 so as to avoid the formation of a ledge at the point of intersection between drain back partition 255 and annular wall member 251. While wall member 610 is a conical segment in the illustrated embodiment, the exact shape of this member is non-critical. In general, a bigger vent/-drain hole 254 and hence a wall member 610 of larger radius is normally employed on more viscous liquids to promote more rapid drain back of spilled and residual liquid.

Figure 13B:
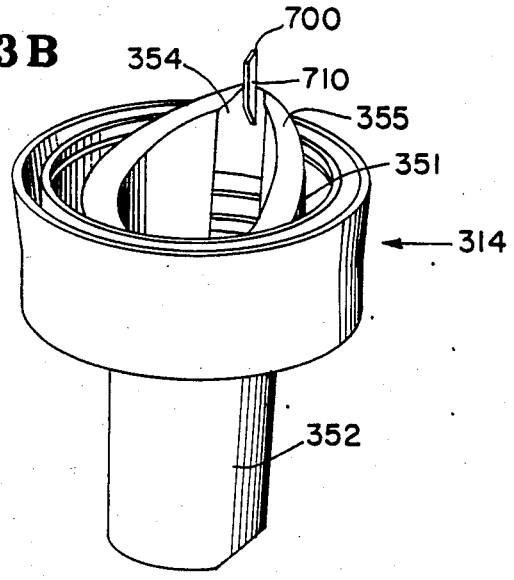
FIG. 13B is a view generally similar to that of FIG. 13A of an alternative transition collar of the present invention.

Transition collar 314 shown in FIG. 13B includes an alternative drip concentrating feature comprising a drip concentrating point 700 formed by a planar rib segment 710 extending from annular wall member 351 and passing through vent/drain hole 354, as generally shown in FIG. 13B. As with the conically shaped wall segment 610 shown in FIG. 13A, planar rib segment 710 is preferably inwardly oriented toward spout 352 as it passes through drain back partition 355. As with wall member 610, the exact shape or cross-section of member 710 is non-critical. Liquid which makes contact with the uppermost surface of planar rib segment 710 readily follows the downward trajectory of the segment 710 to its lowermost drip concentrating point 700.

Figure 10:
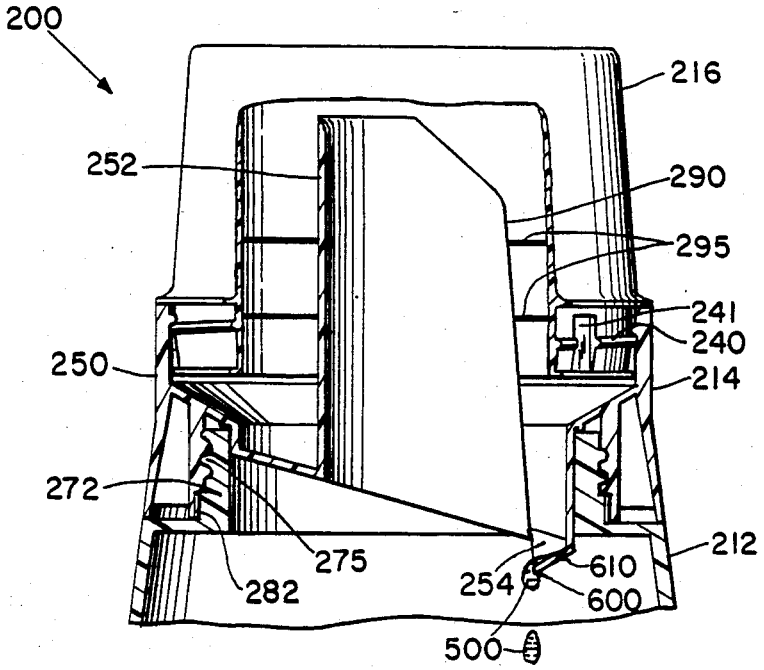
FIG. 10 is a fragmentary vertical cross-sectional view of a dispensing and measuring package of the present invention in a closed condition when a substantial period of time has passed following a dispensing cycle.

As can be seen in FIG. 10, the drip concentrator comprising the lowermost point 600 on wall member 610 serves as an accumulator at which any liquid spilled on the exterior surface of the drain back partition or draining back onto the exterior surface of the drain back partition from the cap 216 after a dispensing cycle is completed coalesces. Coalescence of liquid 500 at a single point causes a larger and larger droplet to form at the point 600. When the weight of the droplet finally exceeds the surface tension forces exerted by the liquid on the drip concentrating point 600, the droplet falls back into the container, as generally shown in FIG. 10. This droplet formation and dislodging process is continuously repeated until the bulk of the liquid has been redeposited into the container. Thus, after an extended period of time following a liquid dispensing cycle, little if any liquid remains on the exterior surface of the drain back partition 255 for the next dispensing cycle.

Figure 14:
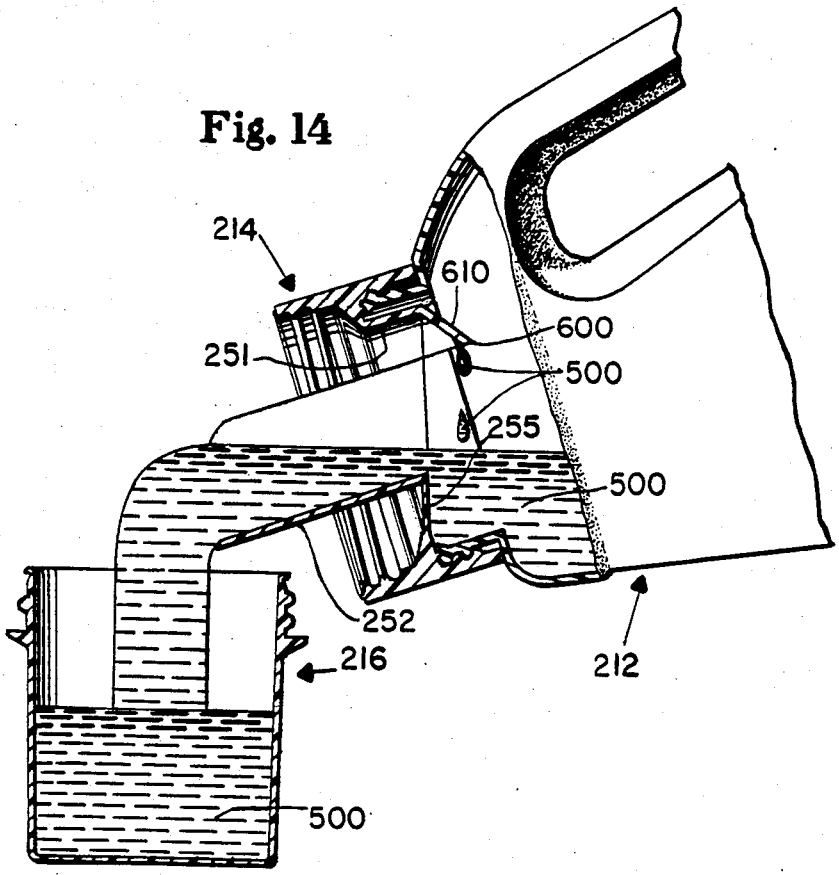
FIG. 14 is a fragmentary vertical cross-sectional view of the package shown in FIG. 10 during a subsequent dispensing operation with its measuring cup performing its measuring function.

In addition, even when, as shown in FIG. 14, the container 212 is reoriented to again dispense liquid 500 into cup 216, point 600, due to the generally inward orientation of wall member 610 toward spout 252, remains the lowermost surface for the liquid to adhere to. Furthermore, should any liquid adhering to drip concentrating point 600 be dislodged by reorientation of the container 212 to a pouring position, it will fall harmlessly either back into the stream of liquid 500 being dispensed, as generally shown in FIG. 214, or against the interior surface of drain back partition 255.

Accordingly, a liquid product dispensing package of the present invention employing a drip concentrator which directs spilled and residual liquid to a point below the elevation of the exterior surface of the drain back partition permits repeated mess free dispensing cycles without accumulation of the liquid on the exterior of either the transition collar or the container.

Various modifications of the described invention will be apparent to those skilled in the art. Examples of several such variations have already been mentioned above. Other examples include integral formation of the collar or portions thereof and the container, use of the package with or without a measuring cup which also serves as a closure, substitution of a sealingly secured pouring spout closure for the measuring cup closure and the like. Accordingly, the scope of the present invention should be considered in terms of the following claims and is understood not to be limited to the details of structure and operation described and shown in the specification and drawings.

What is claimed is:

1. An improved package for dispensing liquid without contaminating the exterior surfaces of the package, said package comprising:

(a) a container for housing said liquid, said container having a dispensing orifice;

(b) a collar sealingly secured about its periphery to said dispensing orifice, said collar having an outwardly projecting pouring spout generally aligned with the vertical axis of said container, a circumscribing wall extending above the base of said pouring spout, said base of said pouring spout being joined about its periphery to said circumscribing wall by a drain back partition including a drain hole located at the lowermost point of said drain back partition; and (c) a drip concentrating member originating in the lowermost surface of said drain back partition at the periphery of said drain hole and extending generally downwardly from said drain back partition to form a single, predetermined drip concentrating point comprising the lowermost extremity of said drip concentrating member in the interior of said container, said drip concentrating member being so configured and positioned relative to said dispensing orifice in said container that it does not restrict the flow of liquid passing through said dispensing orifice of said container during normal dispensing operations in which said container is not completely inverted, said drip concentrating member also being so oriented relative to said dispensing orifice in said container that it is substantially free of horizontal surfaces on which liquid can accumulate when said container is stored in an upright position intermediate dispensing cycles; whereby liquid deposited on the exterior of said drain back partition during dispensing will be drawn from said drain back partition by said drip concentrating member intermediate dispensing cycles and will coalesce to form a liquid droplet on said drip concentrating point, said droplet continuing to grow in size until such time as the weight of said droplet exceeds the surface tension forces exerted by the liquid comprising said droplet on said drip concentrating point, at which time said droplet falls back into said container, said coalescing cycle repeating itself until substantially all of said liquid deposited on the exterior of said drain back partition is returned to said container.

2. The package of claim 1, including a measuring cup adapted to serve as a closure, said measuring cup having fastening means formed on its external surface, said fastening means being adapted to sealingly secure said cup to the interior surface of said circumscribing wall on said collar with the measuring cup in inverted condition.

3. The package of claim 1 or claim 2, wherein said container is formed with hand hold means for grasping said container, wherein said drain back partition comprises a transverse partition downwardly inclined toward said drain hole, and wherein said drain hole is generally radially aligned with and adjacent to said hand hold means for grasping said container.

4. The package of claim 3, wherein said hand hold measn for grasping said container comprises an integrally formed handle.

5. The package of claim 1 or claim 2, wherein said drain hole is integral with the discharge opening of said pouring spout.

6. The package of claim 1 or claim 2, wherein said drain hole also serves as a vent for said container.

7. The package of claim 1, wherein said container and said collar are integral with one another.

8. The package of claim 1, wherein said drip concentrating member comprises a curved wall segment extending generally downwardly from said drain back partition toward said pouring spout.

9. The package of claim 8, wherein said drip concentrating member comprises a rib segment extending above and below said drain hole, the portion of said rib segment below said drain back partition extending generally downwardly toward said pouring spout.

10. The package of claim 8 or claim 9, wherein the drip concentrating point on said drip concentrating member comprises the lowermost tip of said segment.

11. An improved package for dispensing liquid without contaminating the exterior surfaces of the package, said package comprising:

(a) a container for housing said liquid, said container having an upwardly extending finish provided with a dispensing orifice;

(b) a transition collar sealingly secured about its periphery to said dispensing orifice, said collar having an outwardly projecting pouring spout generally aligned with the vertical axis of said container, a circumscribing wall extending above the base of said pouring spout, said circumscribing wall having fastening means to sealingly secure said collar to said finish on said container, said base of said pouring spout being joined about its periphery to said circumscribing wall by a drain back partition including a drain hole located at the lowermost point of said drain back partition; and (c) a drip concentrating member originating in the lowermost surface of said drain back partition at the periphery of said drain hole and extending generally downwardly from said drain back partition toward said pouring spout to form a single, predetermined drip concentrating point comprising the lowermost extremity of said drip concentrating member in the interior of said container, said drip concentrating member being so configured and positioned relative to said dispensing orifice in said container that it does not restrict the flow of liquid passing through said dispensing orifice of said container during normal dispensing operations in which said container is not completely inverted, said drip concentrating member also being so oriented relative to said dispensing orifice in said container that it is substantially free of horizontal surfaces on which liquid can accumulate when said container is stored in an upright position intermediate dispensing cycles; whereby liquid deposited on the exterior of said drain back partition during dispensing will be drawn from said drain back partition by said drip concentrating member intermediate dispensing cycles and will coalesce to form a liquid droplet on said drip concentrating point, said droplet continuing to grow in size until such time as the weight of said droplet exceeds the surface tension forces exerted by the liquid comprising said droplet on said drip concentrating point, at which time said droplet falls back into said container, said coalescing cycle repeating itself until substantially all of said liquid deposited on the exterior of said drain back partition is returned to said container.

12. The package of claim 11, including a measuring cup adapted to serve as a closure, said measuring cup having fastening means formed on its external surface, said fastening means being adapted to sealingly secure said cup to the interior surface of said circumscribing wall on said collar with the measuring cup in inverted condition.

13. The package of claim 11 wherein said container is formed with hand hold means for grasping said container, wherein said drain back partition comprises a transverse partition downwardly inclined toward said drain hole, and wherein said drain hole is generally radially aligned with and adjacent to said hand hold means for grasping said container.

14. The package of claim 13, wherein said hand hold means for grasping said container comprises an integrally formed handle.

15. The package of claim 11 or claim 12, wherein said drain hole is integral with the discharge opening of said pouring spout.

16. The package of claim 11 or claim 12, wherein said drain hole also serves as a vent for said container.

17. The package of claim 11, wherein said container and said collar are each molded from polymeric material.

18. The package of claim 11, wherein said drip concentrating member comprises a curved wall segment.

19. The package of claim 18, wherein said drip concentrating member comprises a rib segment extending above and below said drain hole.

20. The package of claim 18 or claim 19, wherein the drip concentrating point comprises the lowermost tip of said segment.

* * * * *

UNITED STATES PATENT AND TRADEMARK OFFICE

CERTIFICATE OF CORRECTION

PATENT NO. : 4,696,416

DATED : September 29, 1987

INVENTOR(S) : Delmar R. Muckenfuhs and Robert H. Van Coney

It is certified that error appears in the above-identified patent and that said Letters Patent is hereby corrected as shown below:

Column 1, line 24, "Lida" should read -- Iida --.

Column 1, line 33, after "antidrip" insert -- finger --.

Column 1, line 40, "lida" should read -- Iida --.

Column 3, line 13, "presnt" should read -- present --.

Column 6, line 26, "82" should read -- 62 --.

Column 9, line 54, after "partition" insert -- 255 --.

Column 11, line 29, "measn" should read -- means --.

Column 12, line 42, after "claim 11" insert -- or claim 12,--.

Signed and Sealed this

Fifteenth Day of March, 1988

*Attest:*

*Attesting Officer*

DONALD J. QUIGG

*Commissioner of Patents and Trademarks*